US005205474A

United States Patent [19]

Stuart et al.

[11] Patent Number: 5,205,474

[45] Date of Patent: Apr. 27, 1993

[54] EASY SET-UP CARTON AND METHOD

[75] Inventors: Aurel E. Stuart, Marietta; William Taylor, Riverdale, both of Ga.

[73] Assignee: Oscar Mayer Foods Corporation, Madison, Wis.

[21] Appl. No.: 892,450

[22] Filed: Jun. 2, 1992

[51] Int. Cl.[5] ..... B65D 5/20; B65D 5/48

[52] U.S. Cl. ..... 229/1.5 H; 206/562; 229/904; 493/162

[58] Field of Search ..... 229/120.14, 120.18, 229/1.5 H, 904; 206/561, 562, 565; 493/162

[56] References Cited

U.S. PATENT DOCUMENTS

| | | | |
|---|---|---|---|
| 2,512,963 | 6/1950 | Peiker | 229/904 |
| 2,640,589 | 6/1953 | Foster et al. | 206/562 |
| 2,833,458 | 5/1958 | Toensmeier | 229/904 |
| 2,875,940 | 3/1959 | Dunn | 229/904 |
| 3,005,584 | 10/1961 | Coe | 206/562 |
| 3,253,766 | 5/1966 | Coe | 229/904 |
| 3,326,445 | 6/1967 | Goings | 229/904 |
| 3,434,650 | 3/1969 | Goings | 229/904 |
| 4,335,843 | 6/1982 | Kent | 229/120.14 |
| 4,757,937 | 7/1988 | Maio et al. | 206/562 |

*Primary Examiner*—Gary E. Elkins

*Attorney, Agent, or Firm*—Lockwood, Alex, Fitzgibbon & Cummings

[57] ABSTRACT

A blank and carry-out tray for carrying a variety of food products are provided and the tray is capable of transformation from a storage condition of a substantially flat configuration to an erect and upright useable condition by manipulation of a plurality of foldably connected portions that move similarly to a parallel linkage arrangement and which are provided with a locking mechanism that automatically lock the tray in its upright and useable condition.

16 Claims, 3 Drawing Sheets

EASY SET-UP CARTON AND METHOD

FIELD OF THE INVENTION

The present invention relates to a carry-out tray for food and beverage and more particularly to a carry-out tray formed from paperboard material capable of being folded from a collapsed condition prior to use into an erect usable condition.

BACKGROUND OF THE INVENTION

Carry-out trays and cartons for carrying foods and beverages from fast food restaurants and food vendors such as those at ball parks are widely used. The trays are generally made of a paperboard sheet material folded to form various food and beverage compartments. The compartments are designed to separate different food items and to allow individuals to carry several food items while preventing spillage. Such trays in the past have been designed to be stored in flat configurations and then manipulated just prior to use by a food service supplier into an upright or erect position thus allowing efficient storage and quick conversion to a food carrying tray product.

However, prior art designs had defects such that the trays became unstable when several food products and beverages were placed into the tray, often leading to spillage of the food and beverage products. Additionally, the prior art trays oftentimes required significant manipulation in order to be transformed from the lay flat configuration to the erect usable condition. Also, once in a usable condition the prior art food service trays did not automatically lock into an upright usable position resulting in additional food service supplier time to ready the tray for carry-out use.

SUMMARY OF THE INVENTION

The carry-out tray of the present invention is capable of being easily and quickly manipulated from a collapsed condition prior to use into an erect usable condition. When in its erect condition, a substantially planar top wall is foldably connected at its opposite edges and in substantially perpendicular relationship with a pair of sidewalls substantially parallel to each other. The tray additionally includes a substantially planar bottom wall having an opening wherein the bottom wall of the erect tray is foldably connected in substantially perpendicular relationship to each of the pair of sidewalls. The tray further includes a slidable compartment member which is adjacent the bottom wall when the tray is erect. An integral lock tab of the compartment member is adapted to be extended into the opening of the bottom wall. The erect tray is also provided with an end member substantially perpendicular to the top wall and foldably connected to the compartment member wherein the end member is hingedly secured to each of the pair of sidewalls. An intermediate member foldably connected to the top wall and spaced from and substantially parallel to the end member is provided and is attached to the compartment member to form an open compartment. The intermediate member further includes an integral guide tab depending therefrom to deflect the compartment member lock tab into the opening of the bottom wall for locking the tray in its upright and erect position.

It is therefore a general object of the present invention to provide an improved carry-out tray, blank and method which overcome the limitations of the prior art.

It is a further object to provide a carry-out tray which may be converted from a lay flat collapsed condition into a positively locked, useable tray in an upright and erect condition by a method requiring minimal manipulation.

Yet another object of the present invention is to provide a carry-out tray that automatically locks in its erect position to keep the tray from inadvertently collapsing.

BRIEF DESCRIPTION OF THE DRAWINGS

For a more complete understanding of the present invention reference should now be made to the embodiments illustrated in greater detail in the accompanying drawings and described below by way of example of the invention. It should be understood that the invention is not necessarily limited to the particular embodiments illustrated herein but is defined by the appended claims.

IN THE DRAWINGS

Figure 1:
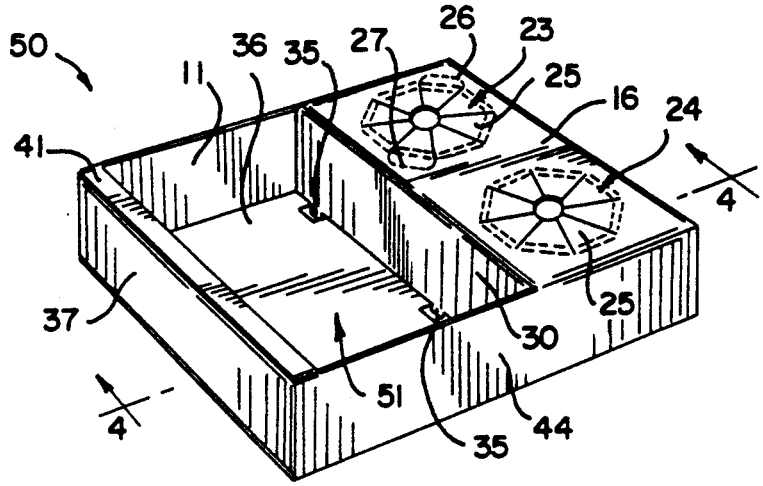

FIG. 1 is a top perspective view of a carry-out tray in an erect and useable position according to the present invention.

Figure 2:
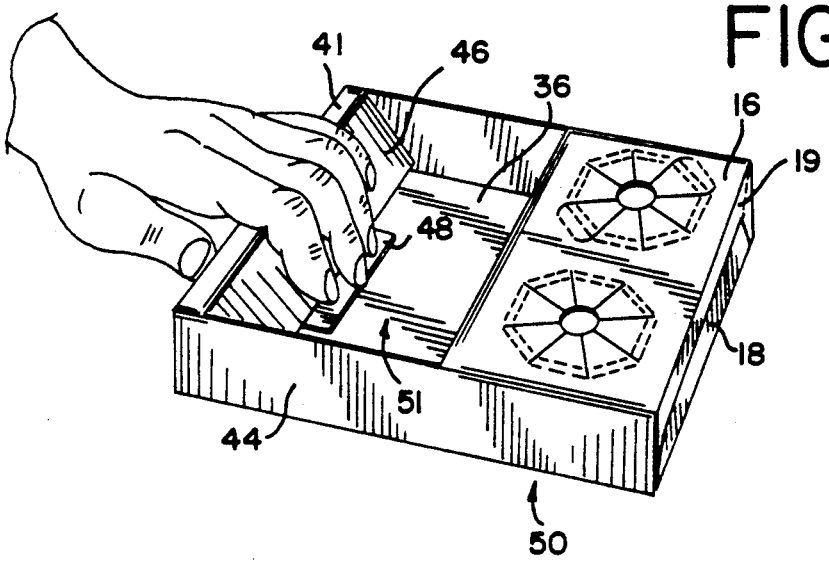

FIG. 2 is a top perspective view of a carry-out tray according to the present invention showing the slidable compartment wall locking the tray into its erect position.

Figure 3:
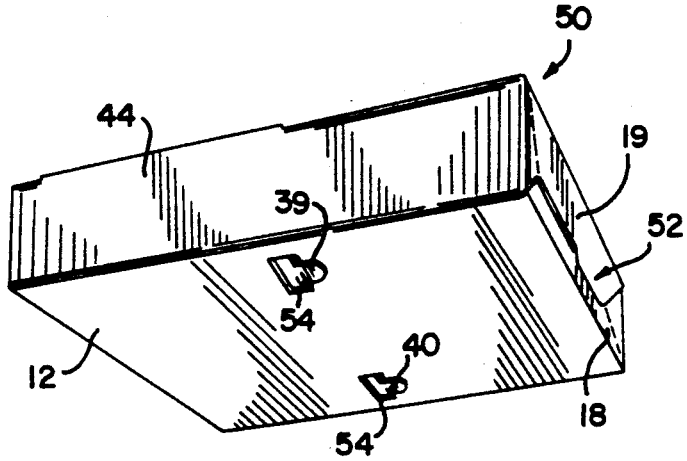

FIG. 3 is a bottom perspective view illustrating the automatically locking tabs of the carry-out tray according to the present invention.

Figure 4:
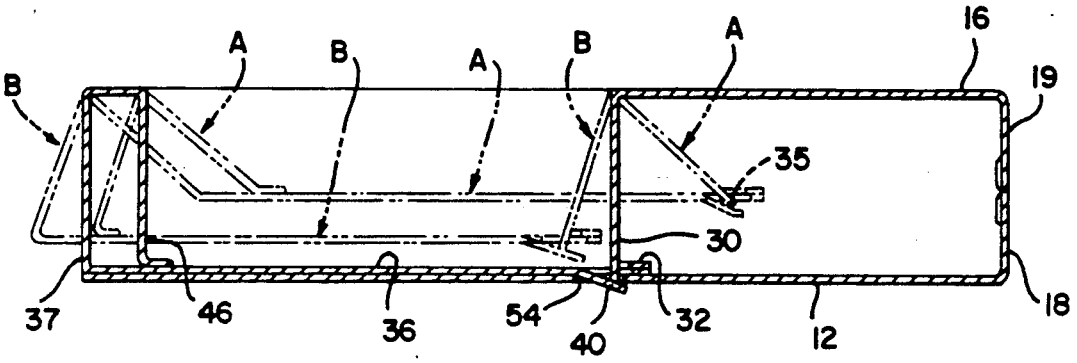

FIG. 4 is a side sectioned view of a carry-out tray in a substantially erect position according to the present invention and interengaging motion of components in phantom.

Figure 5:
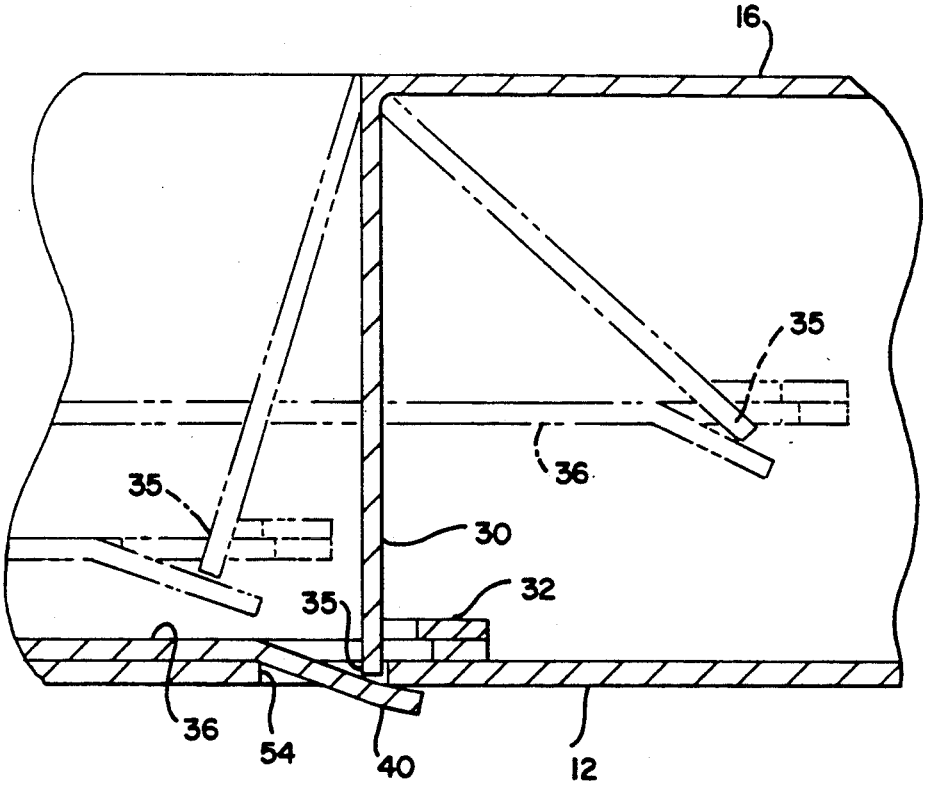

FIG. 5 is an enlarged fragmented side sectioned view of a portion of FIG. 4 illustrating the automatically locking tabs according to the present invention.

Figure 6:
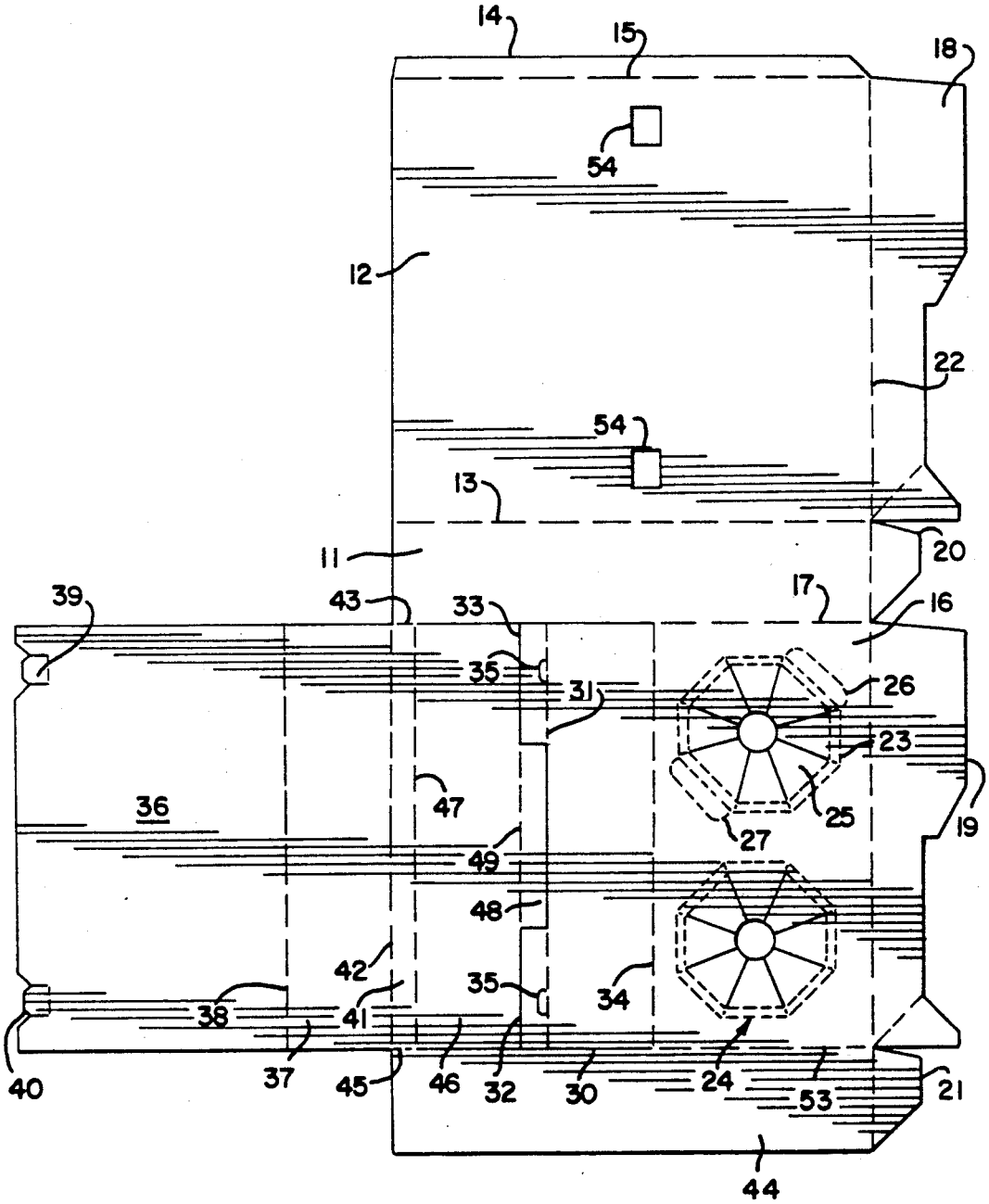

FIG. 6 is a plan view of a paperboard blank useful for making the tray according to the present invention.

DETAILED DESCRIPTION OF THE PREFERRED EMBODIMENT

The basic tray structure which is illustrated in the drawings is formed from a blank 10 of paperboard or similar foldable sheet material and has a generally typical overall construction as seen in FIG. 6. The specific blank 10 which is illustrated includes a sidewall portion 11 foldably connected to a bottom wall portion 12 along fold line 13. The bottom wall portion 12 is provided with one or more spaced openings 54. Suitable means such as an adhesion flap 14 defined by a fold line 15 are included to secure to the bottom wall portion 12 to other portions of the blank.

A top wall portion 16 is foldably connected to sidewall portion 11 along fold line 17. End flap portions 18, 19 and 20, 21 foldably connected to respective edges of the bottom, side, and top wall portions along a fold line 22 can be included to provide material which generally interlocks to form one end of a tray formed from the assembled blank.

The top wall portion 16 is provided with one or more die cut food storage sections 23, 24 made up of foldably connected panels 25 of the top wall 16. A food storage section can be generally octagonally shaped and can include a pair of substantially rectangular die cut portions 26, 27 to provide varied sizing and/or shaping of food storage sections when in use. An intermediate wall portion 30 is foldably connected to the top wall portion 16 along fold line 31. The intermediate wall portion 30 is provided with suitable securement means such as adhesion flaps 32, 33 foldably connected to the intermediate wall portion 30 along fold line 34. Illustrated flaps 32, 33 are provided with integral die cut guide tabs 35 deflectable away from the adhesion flaps 32, 33 and foldably connected to the intermediate wall portion 30 along score line 34. Another sidewall portion 44 is foldably attached to the top wall portion 16 along fold line 53.

In the illustrated embodiment, a compartment wall portion 36 is foldably connected to an outer end wall portion 37 along a fold line 38. The compartment wall portion 36 includes die cut tabs 39, 40. A spacer wall portion 41 is foldably connected to the outer end wall portion 37 along a fold line 42 and is foldably connected to the sidewall portion 11 along a fold line 43 and the sidewall portion 44 along a fold line 45. An inner end wall portion 46 is foldably connected to the spacer wall portion 41 along a fold line 47. A suitable connecting member such as adhesion flange 48 is provided foldably connected to the inner end wall portion 46 along a fold line 49 and is adapted to be attached to the surface of the compartment wall 36 portion.

When the blank 10 of FIG. 6 is folded and glued and erected into the configuration as shown in FIGS. 1, 2, and 3, a carry-out tray 50 is provided. During such a procedure, the blank 10 is folded along fold lines 15, 13, 17 45, and 53 in order to attach the adhesion flap 14 to the sidewall 44. End flaps 18, 19 are glued to end flaps 20, 21 at each corner. Compartment wall portion 36, inner end wall portion 46 and outer end wall portion 37 are folded along fold lines 38, 42, 47 in order to insert the compartment wall portion 36 into the interior area defined by the now attached and formed top wall 16 and bottom wall 12. The intermediate wall portion 30 is then folded along the fold line 31 and the adhesion flaps 32, 33 are folded along the score line 34 in order to glue the adhesion flaps 32, 33 to the top surface of the compartment wall portion 36. The adhesion flange 48 of the inner end wall portion 46 is folded along the fold line 49 in order to glue the adhesion flange 48 to the top surface of the compartment wall portion 36. The thus assembled tray 50 is stored in a substantially flat configuration until it is set up for use in an erect position as shown in FIG. 1.

It should be noted that the substantially flat configuration of the carry-out tray 50 in its glued and folded condition is a generally flattened square section in order to maximize packaging transport and storage efficiency. In one embodiment of this substantially flat configuration, outer end wall 37 is substantially parallel to the inner end wall 46 and generally coplanar with the compartment wall 36. Additionally, intermediate wall 30 is substantially parallel with the top wall 16 and the bottom wall 12 and sandwiched between the top and bottom walls.

When a food service supplier or the like desires to transform the flattened carton into the erect carry-out tray, the flattened carton initially is squared for use by shifting the top wall 16 from a position parallel and substantially adjacent to the bottom wall 12 to a position parallel to and spaced from the bottom wall 12. Sidewalls 11 and 44 are shifted from positions substantially parallel with the top wall 16 to positions substantially perpendicular to the top wall 16. At the same time, end flaps 18, 19 and 20, 21, when provided, become engaged in a manner well known in the art in an interleaved configuration substantially perpendicular to the top wall 16 forming an end wall 52. At this stage, intermediate wall 30, outer end wall 37, and inner end wall 46 are disposed in angled relationship to the top wall 16 as shown by phantom lines A in FIG. 4 at which guide tab 35 is located beyond opening 54 (to the right as viewed in FIG. 4).

Pressure is then supplied by the food service supplier as shown in FIG. 2 to move the outer end wall 37, intermediate wall 30, inner end wall 46 and compartment wall 36 to a pre-insertion position as shown by phantom lines B in FIG. 4 at which guide tab 35 has swung back past the opening 54 (to the left as shown in FIG. 4). It should be understood that the outer end wall 37, intermediate wall 30, and inner end wall 46 swing angularly while the compartment wall 36 is moved substantially laterally. This movement is necessary in this embodiment in order to position the lock tab 39, 40 so that it can be automatically inserted into the opening 54 of the bottom wall 12. Once position B is attained, intermediate wall 30, outer end wall 37, inner end wall 46 and the compartment wall 36 are then moved or slid in the opposite direction (to the right as shown in FIG. 4) such that the lock tab 39, 40 extends through the opening 54 of the bottom wall 12 locking the side wall 30, inner end wall 46 and the outer end wall 37 in substantially perpendicular alignment with the top wall 16 to provide the assembled condition shown in solid lines in FIGS. 4 and 5. It should be noted that the guide tab 35 depends downwardly from the intermediate wall 30 to engage the lock tab 39, 40 angling and extending the lock tab 39, 40 downwardly from the compartment wall 36 to ensure that it extends into the opening 54 of the bottom wall 12.

Alternatively, in a second collapsed configuration embodiment, the glued and folded flattened carton may be configurated such that the inner end wall 46 is substantially parallel with the outer end wall 37 and substantially coplanar with the compartment wall 36. Additionally, intermediate wall 30 is substantially parallel with the bottom wall 12 and substantially coplanar with the top wall 12.

In this second collapsed configuration embodiment, the flattened carton is transformed into the erect tray 50 by shifting the top wall 16 from a position parallel with and adjacent the bottom wall 12 to a position parallel to and spaced from the bottom wall 12. Sidewalls 11, 44 are shifted from a position substantially parallel with the top wall 16 and the bottom wall 12 to a position substantially perpendicular to the top and bottom walls 16 and 12. At the same time, end flaps 18, 19 and 20, 21, when provided, become engaged in a manner well known in the art in an interleaved configuration substantially perpendicular to the top wall 16 forming an end wall 52. At this stage the outer end wall 37, the inner end wall 46 and the intermediate wall 30 are in a position shown by phantom lines B in FIG. 4. A food service supplier then moves the outer end wall 37, the inner end wall 46 and the intermediate wall 30 inwardly (to the right as shown in FIG. 4) such that the lock tab 39, 40 of the compartment wall 36 is deflected downwardly by the guide tab 35 in order to engage and protrude through the opening 54 in the bottom wall 12.

In the upright and erect position as shown in FIG. 1, the carry-out tray 50 is capable of accepting various food and beverage products. Area 51 of the carry-out tray 50 formed from intermediate wall 30, sidewalls 11, 44, compartment wall 36 and inner wall 46 is large enough to hold a large entre such as a sandwich or a hot dog. The food storage sections 23, 24 are capable of holding a variety of different sized food packages, such as beverages or french fries. It will be appreciated that panels 25 of sections 23, 24 when deflected below the surface of top wall 16 provide lateral support to prevent items such as cans or cups of beverages from spilling or moving laterally. Additionally, portions 26, 27 of section 23, also deflectable below the surface of top wall 16, provide additional space and support for oblong or rectangularly shaped items to prevent their movement and spillage.

It will thus be seen that the present invention provides a new a useful carry-out tray for food and beverage formed from a blank of paperboard material which tray and blank have a number of advantages and characteristics, including those pointed out herein and others which are inherent in the invention. Preferred embodiments of the invention have been described by way of example, and it is anticipated that modifications may be made to the described form without departing from the spirit of the invention or the scope of the appended claims.

I claim:

1. A carry out tray for food and beverage formed from a blank of paperboard material capable of being folded from a collapsed condition prior to use into an erect useable condition, said tray in its erect usable condition comprising:

a substantially planar top wall having an integral product receptacle, a pair of substantially parallel sidewalls foldably connected to opposite edges of said top wall, said sidewalls being in substantially perpendicular relationship to said top wall, a substantially planar bottom wall spaced from said top wall, said bottom wall having an opening and foldably connected in substantially perpendicular relationship to each of said pair of sidewalls, a compartment member adjacent said bottom wall, said compartment member having a lock portion extending into the opening of said bottom wall;

an end member substantially perpendicular to said top wall and foldably connected to said compartment member, said end member being rotatively coupled to said pair of sidewalls; and an intermediate member foldably connected to said top wall and spaced from said end member and attached to said compartment member to form an open compartment, said intermediate member having a guide portion depending therefrom deflecting said lock portion of said compartment member into the opening of said bottom wall for locking the tray in its erect usable condition.

2. The invention of claim 1 wherein said end member is rotatively coupled to said pair of sidewalls by a spacer wall wherein said spacer wall is foldably connected to and substantially perpendicular to said end member, and said spacer wall is foldably connected to each of said pair of sidewalls.

3. The invention of claim 1 wherein said product receptacle includes a variable sized opening.

4. The invention of claim 3 wherein said variable sized opening includes a plurality of foldably connected panels of said top wall deflectable below the surface of said top wall and adapted to receive a variety of different shaped food products.

5. The invention of claim 1 wherein said bottom wall includes an adhesion flange foldably connected to said bottom wall and attached to one of said sidewalls.

6. A carry-out tray for food and beverage formed from a blank of paperboard material capable of being folded from a collapsed condition prior to use into an erect useable condition, said tray in its useable condition comprising:

a substantially planar top wall having an integral product receptacle;

a pair of substantially parallel sidewalls foldably connected to opposite edges of said top wall, said sidewalls being in substantially perpendicular relationship to said top wall, a substantially planar bottom wall spaced from said top wall, said bottom wall having an opening and foldably connected in substantially perpendicular relationship to each of said pair of sidewalls, a compartment member adjacent said bottom wall, said compartment member having at least two integral lock tabs extending into the openings of said bottom wall;

an end member substantially perpendicular to said top wall and foldably connected to said compartment member and a spacer member, said spacer member being substantially perpendicular to said end member and foldably connected to each of said pair of sidewalls; and an intermediate member foldably connected to said top wall and spaced from and substantially parallel to said end member and attached to said compartment member to form an open compartment, said intermediate member having at least two integral guide tabs depending therefrom deflecting said lock tabs of said compartment member into the openings of said bottom wall for locking the tray in its erect usable condition.

7. The invention of claim 6 wherein said product receptacle includes one or more variable sized openings formed by foldably connected portions of said top wall deflectable below said top wall and adapted to receive a variety of different shaped food products.

8. The invention of claim 7 wherein said opening is adapted to receive circular products and oblong products.

9. The invention of claim 6 wherein said bottom wall includes an adhesion flange foldably connected to said bottom wall and attached to one of said pair of sidewalls.

10. A method of forming a carry-out food tray from a collapsed lay flat configuration to a substantially erect and upright position wherein said food tray in its upright position includes a top wall, a pair of substantially parallel sidewalls foldably connected to opposite edges of said top wall, a bottom member spaced from said top wall, said bottom member having an opening, a compartment member swingingly secured to said sidewalls and adjacent said bottom member, said compartment member having a lock member adapted to be extended into the opening of said bottom member, an intermediate member foldably connected to said top wall and attached to said compartment member to form an open compartment, said intermediate member having a guide portion depending therefrom, said method comprising the steps of:

shifting said pair of sidewalls from positions substantially parallel with said top wall and bottom member to positions substantially perpendicular to said top wall and bottom member;

moving said compartment member and said intermediate member from a first position wherein the lock member of the compartment member is on one side of the opening in said bottom member to a second position wherein the lock member is on a side across said opening opposite said one side of the opening in said bottom member; and moving said compartment member and said intermediate member from said second position to a third position wherein said tab is inserted in the opening of said bottom member, said step of moving from the second position to the third position including deflecting the lock member with the guide portion to facilitate insertion of the lock member into the opening for locking the tray in its upright and erect position.

11. A method of forming a carry-out food tray from a collapsed, substantially flat configuration to an assembled substantially upright position wherein said food tray in its upright position includes a top wall, a pair of substantially parallel sidewalls foldably connected to opposite edges of said top wall, a bottom member spaced from said top wall, said bottom member having an opening, a compartment member swingingly secured to said sidewalls and adjacent said bottom member, said compartment member having a lock member adapted to be extended into the opening of said bottom member, an intermediate member foldably connected to said top wall and attached to said compartment member to form an open compartment, said intermediate member having a guide portion depending therefrom, said method comprising the steps of:

shifting said pair of sidewalls from positions substantially parallel with said top wall and bottom member to positions substantially perpendicular to said top wall and bottom member; and moving said compartment member and said intermediate member from a first position wherein the lock member of the compartment member is on one side of the opening in said bottom member to a second position wherein said lock member is inserted in the opening of said bottom member, said moving step including deflecting the lock member with the guide portion to facilitate insertion of the lock member into the opening for locking the tray in its upright and erect position.

12. A carry-out tray for food and beverage formed from a blank of paperboard material capable of being manipulated from a collapsed condition prior to use into an erect useable condition, said tray in its collapsed condition comprising:

a substantially planar top wall having a product receptacle;

a pair of substantially parallel sidewalls foldably connected to opposite edges of said top wall, said sidewalls being in substantially perpendicular relationship to said top wall;

a substantially planar bottom wall spaced from said top wall, said bottom wall having an opening and foldably connected in substantially perpendicular relationship to each of said pair of sidewalls;

a compartment member adjacent said bottom wall, said compartment member having a lock tab adapted to be extended into the opening of said bottom wall;

an end member substantially parallel to said top wall and foldably connected to said compartment member, said end member being rotatively coupled to said pair of sidewalls;

an intermediate member foldably connected to said top wall and spaced from said end member and attached to said compartment member, said intermediate member having a guide tab depending therefrom adapted to deflect said lock tab of said compartment member into the opening of said bottom wall.

13. The invention of claim 12 wherein said end member is rotatively coupled to said pair of sidewalls by a spacer wall wherein said spacer wall is foldably connected to said end member and said spacer wall is foldably connected to each of said pair of sidewalls.

14. A blank of sheet material cut and scored for forming a food and beverage tray comprising:

a bottom all portion having an opening, a top wall portion, a first sidewall portion foldably connected to said bottom wall portion and said top wall portion, a second side wall portion foldably connected to said top wall portion, a compartment member having tabs adapted to be inserted into said opening of said bottom wall, an end member foldably connected along an edge of said compartment member and adapted to be attached to a surface of said compartment member, said end member foldably connected to said first and second sidewalls; and an intermediate member foldably connected to said top wall portion and having integral guide tabs and adapted to be attached to said compartment member.

15. The invention of claim 14 wherein said top wall portion includes a die cut portion of foldably connected panels deflectable below the surface of said top wall portion.

16. The invention of claim 14 wherein said end member is foldably connected to a spacer wall portion, said spacer wall portion being foldably connected to said first and second sidewall portions.

* * * * *